US005924159A

United States Patent [19]

Haitin

[11] Patent Number: 5,924,159

[45] Date of Patent: Jul. 20, 1999

[54] TOOTHBRUSH

[75] Inventor: David Haitin, Tel Aviv, Israel

[73] Assignees: LTi-Logital Technologies International Ltd., Ramot-Hashavim; Yossef Knirsh, Rosh Ha'ayin, both of Israel

[21] Appl. No.: 08/834,274

[22] Filed: Apr. 15, 1997

[51] Int. Cl.[6] ..... A46B 9/04

[52] U.S. Cl. ..... 15/105; 15/167.1

[58] Field of Search ..... 15/105, 167.1; 84/94.2

[56] References Cited

U.S. PATENT DOCUMENTS

| | | | |
|---|---|---|---|
| 4,341,230 | 7/1982 | Siahou | 15/167.1 |
| 4,744,124 | 5/1988 | Wang et al. | 15/105 |
| 4,788,734 | 12/1988 | Bauer | 15/105 |
| 4,866,807 | 9/1989 | Kreit et al. | 15/167.1 |
| 4,898,060 | 2/1990 | To | 84/95.2 |
| 5,023,596 | 6/1991 | Sirman et al. . | |
| 5,044,037 | 9/1991 | Brown | 15/167.1 |
| 5,259,086 | 11/1993 | Fong | 15/105 |
| 5,493,274 | 2/1996 | Long . | |
| 5,572,762 | 11/1996 | Scheiner | 84/94.2 |
| 5,673,451 | 10/1997 | Moore et al. | 15/105 |

FOREIGN PATENT DOCUMENTS

| | | | |
|---|---|---|---|
| 2047532 | 12/1980 | United Kingdom | 15/105 |

*Primary Examiner*—Terrence R. Till
*Attorney, Agent, or Firm*—Bacon & Thomas, PLLC

[57] ABSTRACT

A brush including a motion sensor, mounted in the brush, and arranged to provide output signals corresponding to movements of the brush, an audible signal generator, and a controller which activates the signal generator in response to the output signals from the motion sensor.

12 Claims, 1 Drawing Sheet

TOOTHBRUSH

FIELD OF THE INVENTION

The present invention relates to brushes in general and, in particular, to toothbrushes.

BACKGROUND OF THE INVENTION

Proper brushing of the teeth is very important for oral hygiene but it is often difficult for the brusher to know whether or not he is brushing correctly. Furthermore, especially for children, it is difficult to provide an incentive to brush frequently and properly.

Similarly, brushing hair, particularly long hair, is often a chore since brushing requires many strokes, although the rate is not important.

There are known toothbrushes having built-in sound generators. These toothbrushes generally include sound generators inside an enlarged handle, and an on-off switch on the handle, where the toothbrush is held by the user. These toothbrushes are characterized by a switch which is turned on manually when the toothbrush is gripped by the user. In many, the handles are too large to fit into standard toothbrush holders. An alternative toothbrush is described in U.S. Pat. No. 5,572,762 to Scheiner. This toothbrush includes a handle of standard dimensions, and a switch having a push-button which extends from an opening in the proximate end of the toothbrush handle. All these devices play melodies according to whether the switch has been manually turned on or off, without taking into account the quality of brushing.

Accordingly, it would be very desirable to have a toothbrush or hairbrush which indicates when brushing is at a correct rhythm and force, which provides audible feedback to the user during brushing, and which rewards the brusher for frequent, correct brushing of the proper duration via special feedback.

SUMMARY OF THE INVENTION

According to the present invention, there is provided a brush including a motion sensor mounted in the brush, an audible signal generator, and a controller which activates the signal generator in response to output signals from the motion sensor.

According to a preferred embodiment of the invention, the signal generator generates a different signal for different brushing rhythms detected by the sensor.

According to another preferred embodiment, the controller also calculates a score for each brushing, counts scores above a certain threshold score until it reaches a predetermined number of scores, then causes the signal generator to generate a special signal.

Further according to a preferred embodiment, the signal generator includes a piezoelectric element.

Still further according to a preferred embodiment, the motion sensor includes a spring which forms part of an electric circuit.

There is also provided in accordance with the present invention a method for providing music in a brush, the method including the steps of mounting a motion sensor, an audible signal generator, and a controller in the brush; sensing movements of the brush by the motion sensor, the motion sensor providing an output signal corresponding to the movements; causing the controller to activate the signal generator to generate a melody in response to the output signal; causing the controller to deactivate the signal generator when the motion sensor ceases to sense continuing movements.

BRIEF DESCRIPTION OF THE DRAWINGS

The present invention will be further understood and appreciated from the following detailed description taken in conjunction with the drawings in which:

FIG. 5 is a flow chart of the controller logic.

DETAILED DESCRIPTION OF THE INVENTION

The present invention relates to brushes which encourage and reward brushing in the proper direction and at the proper rhythm. Since this is particularly applicable to toothbrushing, the present invention will be described hereinbelow with reference to a toothbrush. However, it will be appreciated that the invention is also applicable to hair brushes and other devices requiring movements of a certain speed, force or duration wherein encouragement or reward during brushing is desirable.

This goal is accomplished by mounting in the brush a motion sensor which provides output signals corresponding to the rhythm of motion of the brush, preferably in a defined direction. The output signals are received by a controller, which activates a signal generator to play one of a number of melodies, depending on the detected rate of motion or the duration of motion. It will be appreciated that the signal generator in the brush is thus turned on and off without any external switch. Preferably, the controller also records the number of and time interval between correct brushings and, when a certain threshold is passed, an additional special success signal is generated when the brush is first moved.

Figure 1:
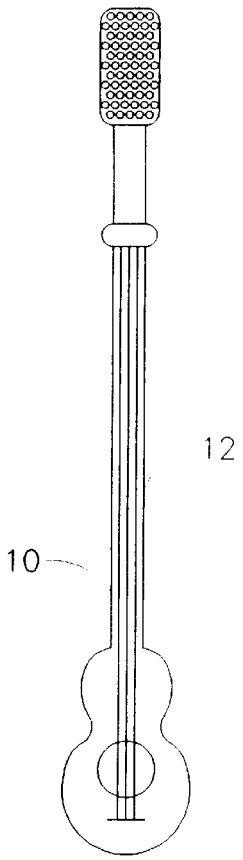
FIG. 1 is a plan view of a toothbrush constructed and operative in accordance with one embodiment of the present invention.

Referring now to FIG. 1, there is shown in plan view a toothbrush 10 constructed and operative in accordance with one embodiment of the present invention. In this embodiment, the toothbrush is shaped like a guitar. The various additional elements of the device are mounted inside the handle, in the guitar body, as described below.

Figure 2:
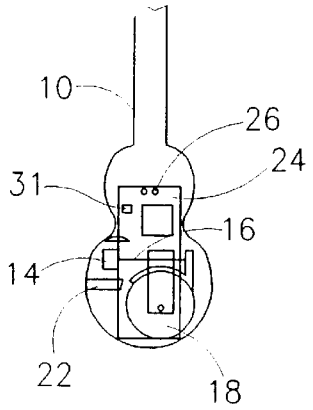
FIG. 2 is a rear view of the toothbrush of FIG. 1 in an open orientation.
Figure 3:
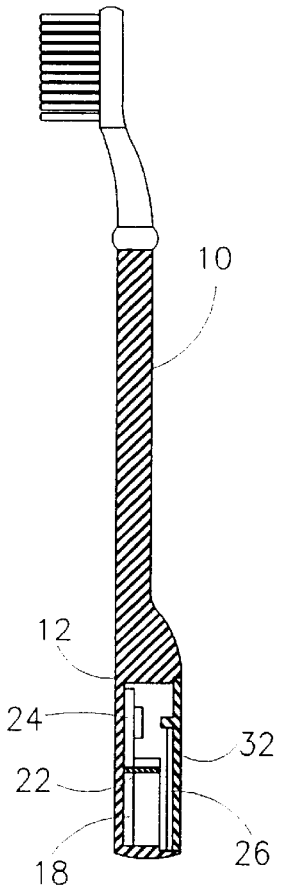
FIG. 3 is a side sectional view of the toothbrush of FIG. 1.
Figure 4:
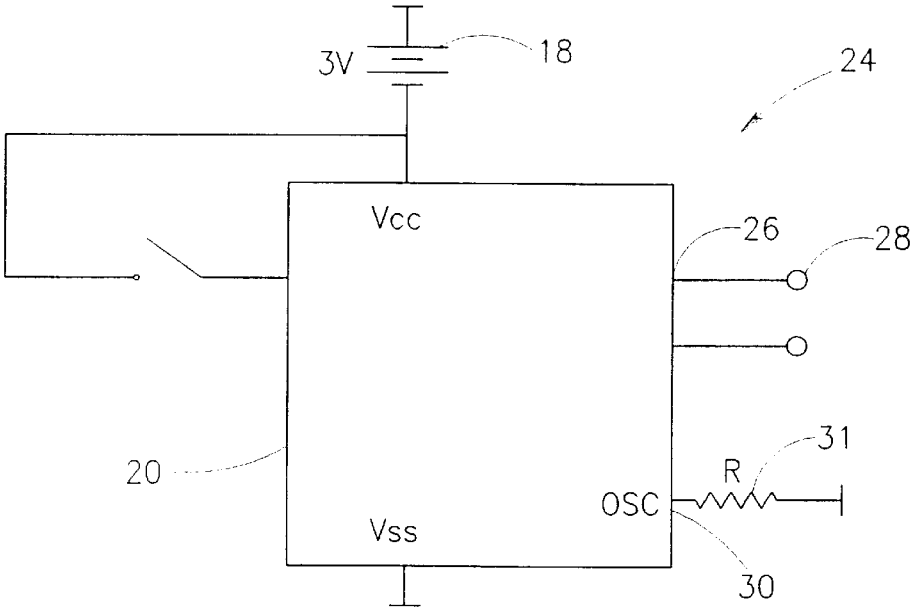
FIG. 4 is a schematic diagram of an electric circuit operational in the toothbrush of the present invention.

With reference to FIGS. 2 and 3 there are shown respective rear and side sectional views of the handle 12 of toothbrush 10 of FIG. 1. Inside handle 12 is mounted a tilt or motion sensor 14. Motion sensor 14 may be any sensor of suitable size which is operative to provide an output signal corresponding to the rhythm and force of movement of the brush. According to the illustrated preferred embodiment, motion sensor 14 includes a spring 16 which serves as a switch in an electric circuit 20, shown in FIG. 4. Spring 16 may be, for example, a 20 mm spring of 2.5 mm diameter. Spring 16 acts as a pendulum, closing the circuit 20 each time the brush is moved with a force above a predetermined threshold.

Electric circuit 20 also includes an energy source 18. Energy source 18 is typically a 3V battery, and is shown here as two standard 1.5V alkaline button cells (24 ma/Hr). As can be seen best in FIG. 3, energy source 18 is retained inside handle 12 by means of a stop element 22, which also serves to limit the motion of spring 16 to prevent it from breaking.

Energy source 18 actuates a controller 24 which, in turn, actuates an audio signal generator 26. Controller 24 is preferably an Application Specific Integrated Circuit (ASIC) micro-controller chip, such as a custom CMOS design made of 3000 gates at 1.8V technology. 1500 gates are used for logic and the rest are ROM stored melodies or other audio signals. In the illustrated embodiment, controller 24 actuates a piezo electric element 28 to generate a selected signal, or play a desired melody. Piezo element 28, which may be a standard 20 mm diameter piezo element, is used as a sound transducer at a frequency range from 600 Hz to 2 khz. Two examples of suitable piezo elements are those manufactured by Betacera Inc., part number BPB-OA38, and DB Products Ltd, Hong Kong, part number 64PE20 0700. An oscillator 30 with associated resistor 31 serves as the ASIC clock.

A cover 32 closes handle 12 and is sealed, as with glue, so as to prevent ingress of water.

A flow chart of the logic of the ASIC micro-controller chip is provided in FIG. 5. As can be seen, the controller performs as a state machine.

When the first motion is detected, the clock is started, and the controller waits for a few seconds, while scanning the Tilt (motion sensor) input, to be sure the brush is being used, and wasn't merely picked up and moved aside. If a predetermined number of tilts are detected in that time, then the score counter is reset to zero and an audio signal is selected and played.

A number of melodies of various tempos are stored in the memory of the controller. The selected melody depends on the number of tilt inputs detected in a pre-determined time interval: the greater the number of tilts, the greater the score, and the livelier the music. Thus, a number of pre-defined rhythm or rate ranges are provided in the controller, and the melody is selected according to the range in which the number of tilt inputs falls in a given time interval.

For each time interval, the Tilt counter value is added to the score counter. When no further tilts are counted in a given time interval, the score counter, including the accumulated scores from the first brush movement until there is no brush movement, is compared to a pre-defined threshold. If the brushing was satisfactory and the score is greater than the pre-determined minimum, a counter for Good Score Days is increased by one. When the counter reaches a certain number, for example 28, indicating 14 days of good brushing, both morning and evening, a fanfare or other success signal is played at the start of brushing, before the usual melodies.

It will be appreciated that the invention is not limited to what has been described hereinabove merely by way of example. Rather, the invention is limited solely by the claims which follow.

I claim:

1. A brush comprising:

a brush body having brushing elements;

a motion sensor mounted in said brush body and arranged to provide output signals corresponding to rhythmic movements of said brush body;

an audible signal generator; and a controller which activates said signal generator to generate a selected signal corresponding to a rhythm detected by said sensor in response to said output signals from said motion sensor.

2. The brush of claim 1, wherein said signal generator includes a piezoelectric element.

3. The brush of claim 1, wherein said motion sensor includes a spring which forms part of an electric circuit.

4. The brush of claim 1, wherein said controller includes:

a plurality of melodies, each melody associated with a pre-defined range of rhythms or periodic rates of movement; and means to determine within which of said range of rhythms a rhythm detected by said sensor falls and to activate said signal generator to generate a melody associated with said detected range.

5. The brush of claim 1, wherein said controller includes a counter and logic for generating a score corresponding to rhythm and duration of movements of the brush accumulated from a first brush movement until there is no brush movement.

6. The brush of claim 5, wherein said controller further includes:

means for comparing said score with a threshold score and providing an output signal when said score is greater than said threshold score; and a second counter for receiving said output signal and increasing a count in response to said signal.

7. The brush of claim 6, further comprising:

means for comparing the increased count with a threshold count and providing a success output signal to said controller when said count is greater than said threshold count; and means in said controller to activate said audible signal generator to generate an additional success signal in response to said success output signal.

8. A method of providing music in a brush comprising a brush body and brushing elements, the method comprising the steps of:

(a) mounting a motion sensor, an audible signal generator, and a controller in the brush body;

(b) sensing movement of the brush by said motion sensor, said motion sensor providing an output signal corresponding to said movements;

(c) causing said controller to activate said signal generator to generate a melody in response to said output signal; and (d) causing said controller to deactivate said signal generator when said motion sensor ceases to sense continuing movements.

9. The method of claim 8, further comprising the steps of:

(a) causing said controller to determine the rhythm of the brush, after said step of sensing; and (b) causing said controller to activate said signal generator to generate a melody corresponding to said rate of movement.

10. The method of claim 9, wherein said step of causing said controller to activate includes:

(a) causing said controller to compare said rhythm with a plurality of pre-defined or rate ranges to determine in which range said rate of movement falls, a different melody being associated with each range; and (b) causing said controller to activate said signal generator to generate the melody associated with said determined range.

11. The method of claim 9, wherein said step of sensing movements of the brush includes:

(a) calculating a score for each brushing corresponding to said output signal corresponding to said movements; and (b) when said score is greater than a pre-determined threshold score, increasing a counter for Good Score Days by one.

12. The method of claim 11, further comprising the steps of:

(a) counting scores above said threshold score until said counter for Good Score Days reaches a predetermined number of scores and providing a success output signal to said controller;

(b) activating said signal generator to generate a special audible success signal in response to each first movement of the brush after said controller receives said success output signal.

* * * * *

UNITED STATES PATENT AND TRADEMARK OFFICE

CERTIFICATE OF CORRRECTION

PATENT NO. : 5,924,159
DATED : July 20, 1999
INVENTOR(S) : David Haitin

It is certified that error appears in the above-identified patent and that said Letters Patent is hereby corrected as shown below:

On the title page, item 56 add the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 2 | 5 | 3 | 2 | 1 | 2 | 03/1981 | Fujita | | | |
| | | | | | | | | | | | | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | EP | 0 | 2 | 4 | 9 | 5 | 7 6 | B 1 | 04/1987 | Kreit(Abstract) | | | | |
| | | | | | | | | | | | | | | |

Signed and Sealed this

Nineteenth Day of October, 1999

*Attest:*

Q. TODD DICKINSON

*Attesting Officer*

*Acting Commissioner of Patents and Trademarks*